United States Patent [19]

Nishimoto et al.

[11] 4,344,063

[45] Aug. 10, 1982

[54] CLICK SETTING VARIABLE RESISTOR

[75] Inventors: Tadashi Nishimoto, Yawata; Shunzo Oka, Hirakata, both of Japan

[73] Assignee: Matsushita Electric Industrial Co. Ltd., Osaka, Japan

[21] Appl. No.: 225,124

[22] Filed: Jan. 14, 1981

[30] Foreign Application Priority Data

Jan. 25, 1980 [JP] Japan ..... 55-8061[U]

[51] Int. Cl.[3] ..... H01C 10/30

[52] U.S. Cl. ..... 338/160; 338/184; 338/199; 338/162

[58] Field of Search ..... 338/160, 162, 164, 184, 338/199

[56] References Cited

U.S. PATENT DOCUMENTS 2,632,830 3/1953 Aust et al. ..... 338/174 X
3,312,925 4/1967 Frantz ..... 338/172 X
4,081,782 3/1978 Hildreth et al. ..... 338/164 X
4,206,334 6/1980 LaRock ..... 338/164 X

*Primary Examiner*—C. L. Albritton

[57] ABSTRACT

A variable resistor whose operating shaft may be click set or stopped to a preselected angular position when a projection of a click spring, which is mounted together with a wiper arm on a wiper arm mounting member, drops into a click slot of a click disk fitted into a cover or a casing generally in the form of a cup. The click disk is rotatably fitted into the cover or the casing in such a way that a torque required for rotating the click disk relative to the cover or the casing is higher than a first torque required for releasing the projection of the click spring out of the click slot of the click disk when the operating shaft is in a first position, but is lower than a torque required for releasing the projection of the click spring out of the click slot of the click disk when the operating shaft is axially shifted from said first position to a second position.

5 Claims, 4 Drawing Figures

CLICK SETTING VARIABLE RESISTOR

BACKGROUND OF THE INVENTION

The present invention relates to a variable resistor whose operating shaft may be click set or stopped to a preselected angular position.

The prior art rotary variable resistors of the type described above are such that an operating shaft is click set or stopped to a preselected angular position when a projection of a click spring mounted on the operating shaft drops into a mating click slot cut into the surface of a cover or a casing in opposed relationship with the click spring or cut into a click disk mounted in the cover or the casing. These variable resistors have, however, a common disadvantage in that a preselected angular position of a click slot; that is, a preselected click position at which the operating shaft is click set or stopped is fixed and consequently cannot be freely selected. Obviously, it is very advantageous in many respects if the click position can be freely selected.

SUMMARY OF THE INVENTION

The primary object of the present invention is, therefore, to provide a variable resistor whose operating shaft can be click set or stopped at any arbitrarily selected angular position.

According to an embodiment of the present invention, the operating shaft of a variable resistor can be shifted axially between a first position at which the operating shaft is disengaged from a click disk fitted into a cover or a casing and a second position at which the operating shaft is engaged with the click disk. The click disk is rotatably fitted or mounted in the casing in such a way that a torque required for rotating the torque disk relative to the cover or the casing is higher than a torque required for releasing a click spring out of the click disk when the rotating shaft is in the first position so that the click disk can be maintained stationary when the operating shaft is rotated, but is lower than a second torque required for releasing the click spring out of the click disk when the operating shaft is shifted to the second position so that the click disk can be rotated in unison with the operating shaft.

The effects, features and advantages of the present invention may be summarized as follows.

(1) The click position; that is, the angular position at which the operating shaft is click set or stopped, can be freely selected only by pulling or pushing the operating shaft to the second position and rotating the click disk; that is, the click slot thereof to a desired angular position. Since the operating shaft is shifted axially, its play can be reduced to a minimum level.

(2) The construction is extremely simple; only a minimum number of parts is required; and the number of assembly steps can be reduced to a minimum so that the mass production at less cost becomes possible.

(3) The click disks are mass produced by plastic molding, by which the smooth click operation can be ensured.

(4) The click disk which is fitted into the cover or the casing can be securely held in stationary position or freely rotated when the click disk is received by a retaining ring or the like which in turn is fitted into the cover or the casing and securely held in position by engagement of a positioning tab struck out of the cover or the casing and a mating tab slot cut into the retaining ring or the like.

(5) In the second position the operating shaft can be positively engaged with the click disk through a coupling means in such a way that a torque required for releasing the click spring out of the click disk becomes higher than a torque required for rotating the click disk relative to the retaining ring or the cover or the casing, whereby the click disk can be accurately rotated in unison with the rotating shaft to a desired angular position.

The above and other objects, effects and features of the present invention will become more apparent from the following description of one preferred embodiment thereof in conjunction with the accompanying drawings.

DESCRIPTION OF THE PREFERRED EMBODIMENT

Figure 1:
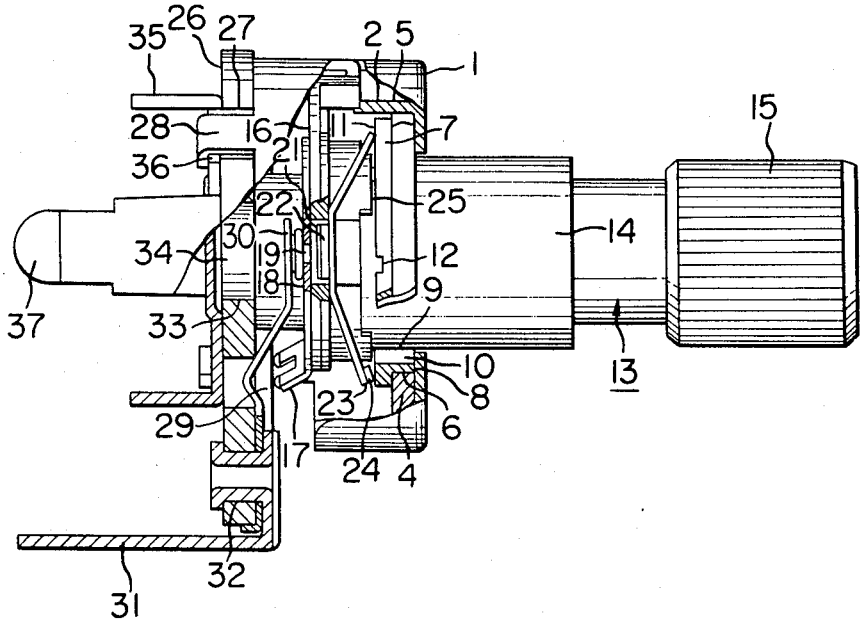
FIG. 1 is a side view, partly in section, of a variable resistor in accordance with the present invention.
Figure 2:
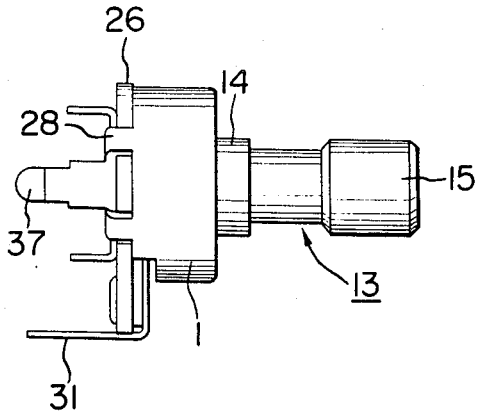
FIG. 2 is a side view, on reduced scale, thereof.
Figure 3:
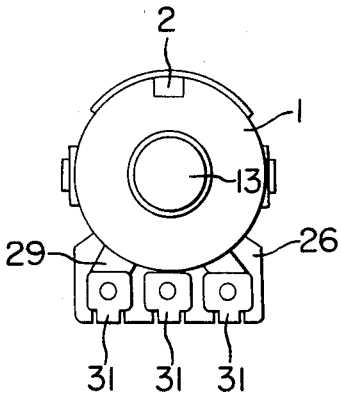
FIG. 3 is a front view thereof.
Figure 4:
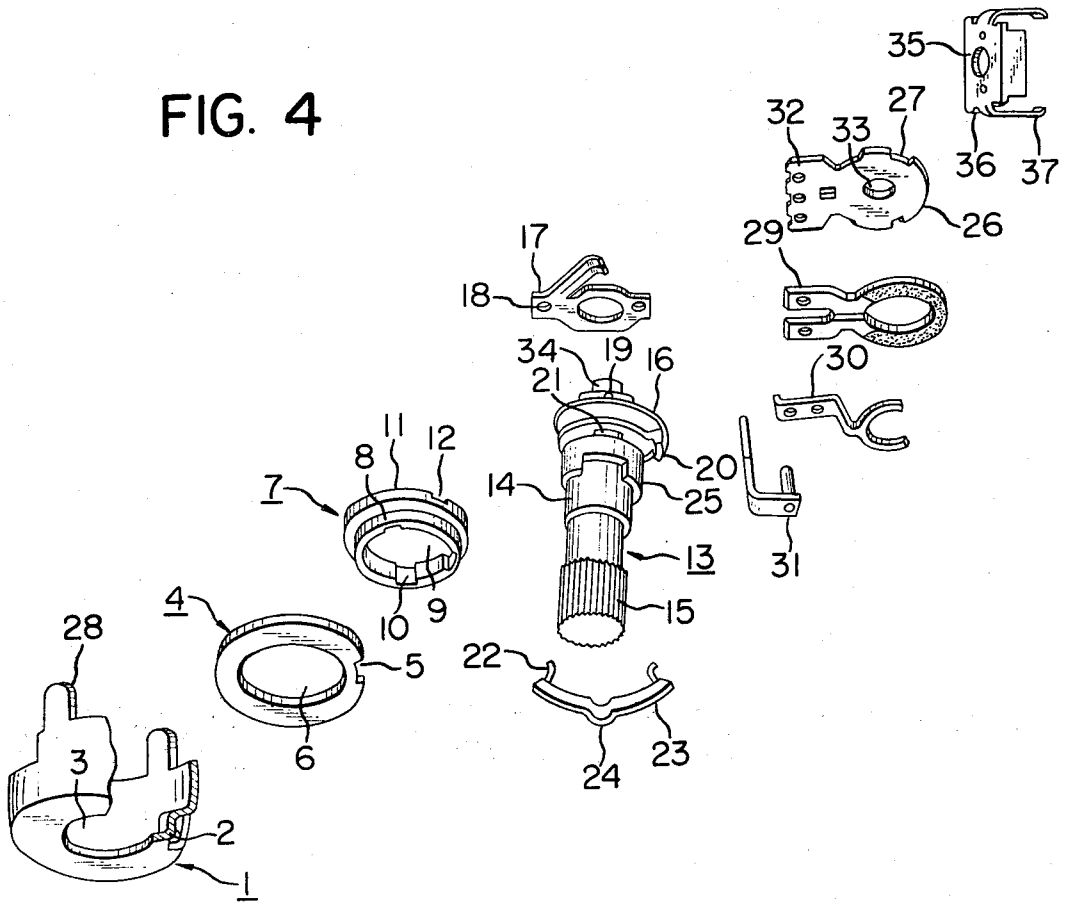
FIG. 4 is an exploded perspective view thereof.

Referring to FIGS. 1 through 4, a metal cover 1 which is U-shaped in cross section has a positioning tab 2 struck out of the bottom and side wall thereof and a center aperture 3. A retaining ring 4 is made of a synthetic resin and has a tab slot 5 which engages with the positioning tab 2 of the cover 1 when the retaining ring 4 is fitted into the cover. The retaining ring 4 has a hole 6 which is slightly greater in diameter than the center aperture 3 of the cover 1. A ring-shaped click disk 7 has a spigot-like projection or neck 8 which in turn is rotatably fitted into the center hole 6 of the retaining ring 4. The disk 7 has a center aperture or bore 9 which is substantially equal in diameter to the center aperture 3 of the cover 1. The inner cylindrical surface of the center aperture or bore 9 is cut with a plurality of equiangularly spaced slots or internal splines 10. The top or sliding surface 11 of the click disk 7 is formed with a click slot 12.

An operating shaft 13 is made of a synthetic resin and has a knob portion 15 and a bearing portion 14 which is rotatably fitted into the center bore 9 of the click disk 7 and the center aperture 3 of the cover 1. A wiper arm mount 16 is affixed to the operating shaft 13 at the end opposite to the knob portion 15 and engaging pins 19 are extended upward from the wiper arm mount 16. These pins 19 are fitted into engaging holes 18 of a wiper arm 17 and then clinched over the upper surface of the wiper arm 17 so that the latter may be securely mounted on the wiper arm mount 16. A stop projection 20 is extended axially downward from the wiper arm mount 16 for engagement with the positioning tab 2 of the cover 1 so as to limit the angle of rotation of the operating shaft 13. Pawls 22 of a click spring 23 are securely fitted into engaging holes 21 formed in the lower surface of the wiper arm mount 16 so that the click spring 23 is mounted on the operating shaft 13. When a projection 24 of the click spring 23 engages with the click slot 12 of the click disk 7, the operating shaft 13 is clicked. The bearing portion 14 of the operating shaft 13 is formed with a plurality of teeth or external splines 25 for engagement with the slots or internal splines 10 of the click disk 7. These teeth or external splines 25 are so positioned that when the projection 24 of the click spring 23 is made into engagement with the click slot 12 of the click disk 7 and then the operating shaft 13 is pulled, the external splines 25 can engage with the internal splines 10 of the click disk 7.

A base plate 26 has recesses 27 cut in the peripheral surface. Lugs 28 of the cover 1 are made into engagement with these recesses 27 and then bent or clinched over the outer surface of the base plate 26, whereby the base plate 26 may be securely mounted on the cover 1. A horseshoe-shaped resistor 29 and a contactor 30 are mounted on the inner surface of the base plate 26 and securely joined thereto with pins of terminals 31 fitted into the holes 32 of the base plate 26 and the holes of the resistor 29 and contactor 30 and bent or clinched over the outer surface of the base plate 26. The wiper arm 17 is made into sliding contact with the resistor 29 as the operating shaft 13 is rotated. The contactor 30 is made into stationary contact with the wiper arm 17. A projection 34 extended from the end of the operating shaft 13 opposite from the knob portion 15 is fitted into a center aperture 33 of the base plate 26. A metal mounting plate 35 is mounted on the outer surface of the base plate 26 in such a way that the lugs 28 of the cover 1 are engaged with recesses 36 of the metal mounting plate 35 and then clinched over the outer surface thereof. Two mounting legs 37 are extended from the metal mounting plate 35 in parallel with the terminals 31.

Next the mode of operation of the variable resistor with the above-described construction will be described in detail. When the operating shaft 13 is rotated, the projection 24 of the click spring 23 slides over the sliding surface 11 of the click disk 7 and drops into the click slot 12. Then the operating shaft 13 is clicked. The click disk 7 is fitted into the center aperture 6 of the retaining disk 4 in such a way that the torque required for rotating the click disk 7 relative to the retaining ring 4 is higher than the torque required for releasing the projection 24 of the click spring 23 out of the click slot 12 of the click disk 7. As a result, when the operating shaft 13 is rotated, the click disk 7 remains stationary.

When the projection 24 of the click spring 23 is made into engagement with the click slot 12 of the click disk 7 and then the operating shaft 13 is pulled, the external splines 25 of the operating shaft 13 engage with the internal splines 10 of the click disk 7 as described previously. As a result, the click disk 7 is rotated in unison with the operating shaft 13 so that the angular position of the click slot 12; that is, the click position can be arbitrarily selected. After a new click position; that is, the angular position of the click slot 12 has been suitably selected in the manner described above, the operating shaft 13 is pushed back. The click disk 7 is fitted into the retaining ring 4 in such a way that the torque required for rotating the click disk 7 relative to the retaining ring 4 is lower than the torque required for releasing the projection 24 of the click spring 23 which is pressed against the click slot 12 of the click disk 7 under an increased pressure when the operating shaft 13 is pulled. As a result, when the operating shaft 13 is pulled and rotated, the click disk 7 is also caused to rotate with the shaft 13 while keeping engagement with the click spring 23. Thus the click position; that is, the angular position of the click slot 12 can be freely selected. As the operating shaft 13 is rotated, the wiper arm 17 slides over the resistor 29 so that the resistance of the variable resistor can be changed as is well known in the art.

So far in order to change the angular position of the click slot 12; that is, the click position, the operating shaft 13 has been described as being pulled and rotated through a desired angle, but it is to be understood that a variable resistor may be so designed and constructed that when the operating shaft 13 is pushed, the engaging force between the projection 24 of the click spring 23 and the click slot 12 of the click disk 7 may be increased. Furthermore, the retaining ring 4 may be eliminated if the click disk 7 is rotatably received in the cover 1 in such a way that when the operating shaft 13 is pulled or pushed, the torque required for rotating the click disk 7 relative to the cover 1 is lower than the torque required for releasing the spring click out of the click slot 12, but when the operating shaft 13 is pushed or pulled back, the former torque is higher than the latter torque so that the click disk 7 may be maintained stationary when the operating shaft 13 is rotated. In addition, the wiper arm mount 16 may be fabricated independently of the operating shaft 13. Instead of the spline engagement or coupling between the click disk 7 and the operating shaft 13 when the latter is pulled or pushed, any other suitable coupling means may be considered and used. As described previously, when the operating shaft 13 is pulled or pushed, the click spring 23 is pressed against the click disk 7 with an increased force. It is obvious that the force exerted to the spring 23 must be lower than a yielding strength of the spring 23.

What is claimed is:

1. A click setting variable resistor of the type comprising:

a cover;

a base plate mounted on said cover so as to close the open end thereof, said cover and base plate cooperating to form a housing;

a resistor and a contactor mounted on said base plate, said resistor and contactor having arcuate portions;

an operating shaft substantially perpendicular to said base-plate and rotatably extended through a wall of said housing;

a wiper arm mounting member interposed between the closed end of said cover and said base plate adjacent said shaft;

a wiper arm mounted on said wiper arm mounting member for rotation by said shaft in such a way that finger means extending from said wiper arm electrically bridges between the arcuate portions of said resistor and said contactor;

a click disk or plate fitted into said cover and provided with a click slot; and a click spring mounted on said wiper arm mounting member and provided with a projection adapted to engage with said click slot of said click disk, whereby when said projection of said click spring drops into said click slot of said click disk, said operating shaft is click set;

said click disk being rotatably fitted into said cover in such a way that the torque required for rotating said click disk relative to said cover is greater than a first torque for releasing said projection of said click spring out of said click slot of said click disk when said operating shaft is in a first position, but is lower than a second torque required for releasing said projection of said click spring out of said click slot of said click disk when said operating shaft is in a second position;

all of said torques being produced when said operating shaft is rotated; and said operating shaft being shifted axially between said first and second positions.

2. A click setting variable resistor as set forth in claim 1 wherein said operating shaft and said click disk are releasably coupled through a coupling means in such a way that after said projection of said click spring has engaged with said click slot of said click disk and then said operating shaft is shifted to said second position, said operating shaft and said click disk are coupled.

3. A click setting variable resistor as set forth in claim 2 wherein said coupling means comprises:

a plurality of axially extended grooves cut in the inner peripheral surface of a center aperture of said click disk; and a plurality of axially extended ridges formed on the outer peripheral surface of said operating shaft and adapted to engage with said axially extended grooves of said click disk only when said operating shaft is shifted to said second position after said projection of said click spring has been made into engagement with said click slot of said click disk.

4. A click setting variable resistor as set forth in claim 1 wherein a retaining ring is fitted into said cover and locked in position with a suitable locking means; and an engaging projection extended from said click disk coaxially thereof is fitted into a center aperture of said retaining ring.

5. A click setting variable resistor as set forth in claim 4 wherein a positioning tab is struck out of said cover and adapted to engage with a mating tab slot of said retaining ring when the latter is fitted into said cover, whereby said retaining ring is nonrotatably received in said cover.

* * * * *